US006336500B2

(12) United States Patent
Hyppanen

(10) Patent No.: US 6,336,500 B2
(45) Date of Patent: Jan. 8, 2002

(54) METHOD AND APPARATUS FOR CONTROLLING HEAT TRANSFER FROM SOLIDS PARTICLES IN A FLUIDIZED BED

(75) Inventor: Timo Hyppanen, Karhula (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 08/996,124

(22) Filed: Dec. 22, 1997

Related U.S. Application Data

(63) Continuation-in-part of application No. PCT/FI97/00405, filed on Jun. 24, 1997.

(30) Foreign Application Priority Data

Jun. 27, 1996 (FI) ..... 962653

(51) Int. Cl.[7] ..... F28F 27/00

(52) U.S. Cl. ..... 165/96; 165/104.14; 422/145; 422/146; 422/147; 122/4 D

(58) Field of Search ..... 165/104.14, 96; 422/145, 146, 147; 122/4 D

(56) References Cited

U.S. PATENT DOCUMENTS

| | | | | |
|---|---|---|---|---|
| 3,565,022 | A | 2/1971 | Bishop | 110/342 |
| 4,544,020 | A | 10/1985 | Chrysostome et al. | 165/96 |
| 4,578,366 | A | 3/1986 | Cetinkaya et al. | 502/6 |
| 4,674,560 | A | 6/1987 | Marcellin | 165/96 |
| 4,753,180 | A | 6/1988 | Narisoko et al. | 110/346 |
| 5,003,931 | A | 4/1991 | Huschauer | 122/4 D |
| 5,054,436 | A | 10/1991 | Dietz | 122/4 D |
| 5,184,671 | A | 2/1993 | Alliston et al. | 165/104.16 |
| 5,273,000 | A | 12/1993 | Regan | 122/4 D |

FOREIGN PATENT DOCUMENTS

| | | |
|---|---|---|
| GB | 761072 A | 11/1956 |
| GB | 929156 A | 6/1963 |

*Primary Examiner*—Christopher Atkinson
(74) *Attorney, Agent, or Firm*—Nixon & Vanderhye P.C.

(57) ABSTRACT

A method of and apparatus for controlling heat transfer in a fluidized bed reactor having a heat transfer chamber (312) with a bed (314) of solid particles therein, means (320,322) for introducing fluidizing gas into the heat transfer chamber for fluidizing the bed of solid particles therein and heat transfer surfaces (316) in contact with the bed of solid particles in the heat transfer chamber. Heat is transferred to said heat transfer surfaces from the solid particles. The fluidization of the bed of solid particles is varied according to a periodical function, e.g. by control means (34) periodically varying the flow velocity of fluidizing gas being introduced into the heat transfer chamber. Thereby the instantaneous heat transfer, as well as, the effective heat transfer from solid particles to the heat transfer surfaces may be controlled.

20 Claims, 5 Drawing Sheets

METHOD AND APPARATUS FOR CONTROLLING HEAT TRANSFER FROM SOLIDS PARTICLES IN A FLUIDIZED BED

This is a continuation-in-part of PCT application No. PCT/FI97/00405, filed Jun. 24, 1997.

FIELD OF THE INVENTION

The present invention relates to a method of and an apparatus for controlling heat transfer in a fluidized bed reactor, according to the preambles of appended independent claims.

The present invention particularly relates to a method and an apparatus for recovering heat from solid particles in a fluidized bed reactor comprising a processing chamber, having a fluidized bed of solid particles therein, and a heat transfer chamber, being in solid particle communication with the processing chamber and having heat transfer surfaces disposed therein. The heat transfer chamber may be connected in various ways to the processing chamber so that there is solid particle exchange between the chambers. The heat transfer chamber may in some special case even be formed within the processing chamber itself.

The present invention relates to a method and apparatus applicable in atmospheric, as well as, pressurized fluidized bed reactor systems.

BACKGROUND OF THE INVENTION

Fluidized bed reactors, such as circulating fluidized bed reactors, are used in a variety of different combustion, heat transfer, chemical or metallurgical processes. Typically heat, originating from combustion or other exothermic processes, is recovered from the solid particles of the fluidized bed by using heat transfer surfaces. Heat transfer surfaces conduct the recovered heat to a medium, such as water or steam, which transports the heat from the reactor.

Said heat transfer surfaces are usually located in the. processing chamber or within a convection section arranged in the gas pass after the processing chamber or, in circulating fluidized bed reactors, within a particle separator. Additional heat transfer surfaces may be arranged in separate heat transfer chambers (HTC), which may be a part of the processing chamber, a separate chamber adjacent to the processing chamber or, in circulating fluidized bed reactors, part of the solid particles recycling system.

In a heat transfer chamber (HTC), heat is typically recovered by continuously introducing hot solid particles from e.g. the processing chamber into the HTC, recovering heat from said solid particles in the HTC, and continuously discharging said solid particles from the HTC into the processing chamber. Said heat recovery takes place by using heat transfer surfaces disposed in the HTC.

The HTC thereby comprises inlet means for introducing a continuous flow of hot solid particles from the processing chamber into the HTC, heat transfer surfaces and means for transporting the heat recovered from the hot solid particles out from the HTC, and outlet means for continuously recycling solid particles discharged from the HTC into the processing chamber.

Accurate and fast controllability of the heat transfer is an important consideration in many applications of fluidized bed reactors, such as where maintaining constant steam temperature may require rapid and accurate adjustments of heat transfer. The reason for the need of controlling action may be a changing demand of the produced steam or abnormality in the fuel quality or fuel feed or some other abnormality in the system. Also there may be a need to adjust the system to proper operating state. In steam boilers, additional requirements to adjust the heat transfer arise from the fact that heat is usually recovered in many stages, i.e. in evaporators, superheaters, economizers and reheaters, which may need independent control, From the point of view of the processes in a fluidized bed reactor, the aim of the heat transfer control is to maintain optimum performance, especially taking into account the harmful emissions or combustion efficiency. Usually, this implies that the temperature of the reactor should stay constant, even in conditions of varying heat recovery and fuel input rates.

In circulating fluidized bed reactors, the rate of heat recovery in the upper parts of the furnace can be varied by changing the bed density. This can be realized by collecting part of the bed material to a storage, as shown in U.S. Pat. No. 4,823,739 or, more simply and quickly, by changing the fluidizing gas velocity. However, the fluidizing gas is an important factor in reactions taking place in the processing chamber of the circulating fluidized bed reactor. To maintain an economically and ecologically favorable operation, changes in the fluidizing gas require other simultaneous changes, such as changes in the fuel feed rate. Thus, this method of heat transfer control effects all heat transfer surfaces of the system and can be favorably put into effect only in the time scale of the thermal time constant of the whole system.

Due to the large heat capacitances involved, the thermal time constant of a fluidized bed reactor, i.e. the time when, after a step-wise stimulus, approximately two thirds of its temperature change has taken place, can be very long, e.g. 25 minutes. Thus, the heat transfer from a fluidized bed based on heat transfer surfaces having an invariable thermal contact to the bed is not fast enough for many applications of fluidized bed reactors.

To render possible a fast control of the heat transfer from fluidized bed reactors, with time constant of e.g. some tens of seconds, different constructions utilizing separate HTCs have been developed. Because also in a HTC the temperature of the solid particles can vary only slowly, different techniques have been developed, which do not depend on varying the temperature of said solid particles to control the heat transfer.

The simplest means for such control is to vary the amount of hot material in contact with the heat transfer surfaces in the HTC so that only a variable part of the heat transfer surfaces are covered by the solid particles. This kind of construction was disclosed e.g. in U.S. Pat. No. 4,813,479. However, to control the level of solid particles at least one additional flow duct and a controlling valve is needed, which increases the complexity and costs of the system.

Another approach, which has been used in circulating fluid bed reactors, is to divide the flow of hot solid particles after the particle separator to two channels, of which only one has heat transfer surfaces. Thus, when varying the division ratio of solid particles flowing through said two channels, the rate of heat transfer is varied. In order to function properly, this technique also requires a rather complicated construction, such as that disclosed in U.S. Pat. No. 5,140,950, in which many compartments and channels are used.

HTCs are normally bubbling fluidized beds with low gas flow velocities, e.g. from 0.1 to 0.5 m/s. The transport of solid particles through a HTC or through its different channels can be controlled by mechanical valves or by varying the fluidizing gas velocity, and thereby the bed height, in different portions of the HTC.

It is known that the heat transfer coefficient of a heat transfer surface in a fluidized bed can to some extent be varied by changing the velocity of fluidizing gas flow. (The heat transfer coefficient refers to the amount of thermal energy transferred across one square meter of the heat transfer surface per one degree temperature difference between the bed and the medium transporting the heat away.) This is due to the fact that with higher velocities of fluidizing gas flow, the solid particle movements are more intense and give a more uniform temperature distribution in the fluid bed, and, thus, the heat transfer on the heat transfer surfaces is enhanced.

Because, in typical HTC constructions, the gas flow velocities are related to the particle flow, they cannot be independently varied. U.S. Pat. No. 5,425,412 discloses an arrangement in the return duct of a circulating fluidized bed reactor, where the HTC contains a separate heat transfer section where the gas flow velocity can be varied independently from the particle flow. Moreover, U.S. Pat. No. 5,406,914 discloses another arrangement with a separate heat transfer section which has also an additional passage for particles directly from the processing chamber to the HTC. With a similar principle can also be constructed a separate HTC, with a heat transfer gas flow which is independent of the particle transfer gas flow.

However, at least when high turn down ratio is needed, the methods disclosed in U.S. Pat. Nos. 5,425,412 and 5,406,914 do not provide ideal control of heat transfer, because in bubbling fluidized beds the heat transfer coefficient typically changes from a low value to a much higher value rather abruptly within a narrow fluidizing gas flow velocity range. Thus, by using the flow velocity as a control parameter, it is not possible to achieve a smooth and continuously controllable operation on a large control range.

It has been suggested in GB patent publication 929,156 a method of heat exchange between a fluid circulating through a heat exchange surface and a granular powdered material by fluidizing the granular powdered material in a pulsating manner. Thereby, during the time of each pulse, the injection of fluidization gas is effected at a velocity which is similar or higher than that of the velocity of fluidization gas during continuous fluidization, whereas no injection of fluidizing gas takes place between the pulses. The periodic pulsations comprise relative short injection periods alternating with longer stationary periods. Thereby two problems mentioned in the GB patent are dealt with. The quantity of fluidizing gas volume is decreased and the granular material is maintained f or longer periods in a state of maximum density.

The method suggested in GB 929,156 does not, however, appear to be applicable in fluidized bed reactors, in which as stable as possible process conditions are desired. All kinds of variations having a negative influence on the process have to be avoided. The great variation in fluidization velocity, i.e. between zero fluidization and a velocity similar to or higher than conventional fluidization velocity, may have such a negative impact on other process variables.

A further drawback of the suggested heat transfer control based on pulsed gas flow velocity, including zero gas flow velocities, is the poor mixing of the solid particles in the HTC. Particularly if after burning takes place, there is a risk of overheating and agglomeration of bed material at some locations of the HTC. It has also been noticed that nozzles in the bottom of a fluidized bed reactor have a tendency to leak unless a minimum gas velocity is maintained in the reactor.

OBJECTS OF THE INVENTION

It is an object of the present invention to provide a method and apparatus for controlling heat transfer in fluidized bed reactors in which the above mentioned drawbacks have been minimized.

It is especially an object of the present invention to provide a method and apparatus in which heat transfer in a HTC in a fluidized bed reactor can be controlled rapidly and accurately over a large control range, even at low heat transfer rates without a risk of overheating.

SUMMARY OF THE INVENTION

The present invention provides an improved method of and apparatus for controlling heat transfer in a fluidized bed reactor, which includes a heat transfer chamber (HTC) with a bed of solid particles therein, means for continuously, i.e. substantially uninterruptedly, introducing fluidizing gas into the heat transfer chamber for fluidizing said bed of solid particles therein and heat transfer surfaces in contact with said bed of solid particles in said heat transfer chamber, the heat transfer surfaces recovering heat from solid particles in the heat transfer chamber. The fluidized bed reactor according to the present invention further comprises means for varying the continuous fluidization of the bed of solid particles in the heat transfer chamber according to a periodical function. The flow of fluidizing gas, which is continuously introduced into the heat transfer chamber, is periodically varied between two or more different flow velocities, for controlling the instantaneous heat transfer from solid particles to said heat transfer surfaces in said heat transfer chamber.

The effective or average overall heat transfer in the heat transfer chamber is thereby controlled by varying a parameter of the periodically varying flow of fluidizing gas being introduced into the heat transfer chamber.

The present invention is applicable in different types of fluidized bed reactors, such as in bubbling fluidized bed reactors or in circulating fluidized bed (CFB) reactors. Thereby the fluidized bed reactor comprises a processing chamber, such as a combustion chamber, in solid particle flow communication with the heat transfer chamber. Heat generated in said processing chamber is thereby recovered with the heat transfer surfaces in the heat transfer chamber. The heat transfer chamber, in which heat transfer is controlled according to the present invention, may even be an integral part of a bubbling fluidized bed reactor, i.e. at least a portion of the bubbling bed itself may form a heat transfer "chamber" zone.

The invention is also applicable in fluidized bed ash coolers, cooling ash and/or other bed material discharged from the combustion chamber of a fluidized bed reactor. The heat transfer chamber may be connected to a CFB as an external heat exchanger in the solid material recirculation loop or as an internal heat exchanger connected to the internal bed material circulation.

Thereby, according to a preferred embodiment of the present invention, there is provided an improved method of recovering heat from solid particles in a fluidized bed reactor, utilizing a HTC, comprising the steps of:

- continuously introducing hot solid particles from the processing chamber into the HTC, and continuously discharging said solid particles from the HTC into the processing chamber,
- recovering heat from said solid particles in the HTC by heat transfer surfaces, varying the flow velocity of fluidizing gas introduced into the HTC according to a periodic function.

Additionally, the method may have the steps of:

observing a possible need to change the heat transfer rate, e.g. by monitoring the temperature of the medium which convects the recovered heat from the HTC, and varying a parameter of the flow velocity of the fluidizing gas, in the heat transfer chamber, to change the effective heat transfer rate in accordance with observed need, There is also according to a preferred embodiment of the present invention, provided an improved apparatus for recovering heat from solid particles in a fluidized bed reactor, utilizing a HTC, said apparatus comprising:

means for continuously introducing solid particles from the processing chamber into the HTC and means for continuously discharging said solid particles from the HTC into the processing chamber heat transfer surfaces for recovering heat from said solid particles and means to transport the recovered heat from the HTC means for providing periodically varying flow of fluidizing gas.

Additionally, the apparatus may have:

means for observing a possible need to vary the heat transfer rate and means for varying a parameter of said periodically varying flow of fluidizing gas.

According to one aspect of the present invention the flow velocity of a continuous flow of gas is alternated between a first and a second flow velocity, said first flow velocity being higher than the second velocity, said first flow velocity thereby providing a higher instantaneous heat transfer from the solid particles to the heat transfer surfaces than the second flow velocity. The flow velocity may, if needed or otherwise desired, be alternated between more than two different flow velocities.

When the flow velocity is alternated between predefined constant values, the lowest velocity should still exceed zero. The lowermost flow velocity should mainly be set to a level which prevents the fluidization nozzles from leaking or being blocked by particles falling into or on the nozzle openings.

In systems where the fluidization gas of the HTC provides a considerable part of the combustion air into the system a minimum flow velocity of gas/air has to be maintained in order not to cause instability to the system. Also a certain minimum flow velocity of air may be needed in order to prevent reducing conditions and increased corrosion attack on heat transfer surfaces from arising.

Due to above mentioned reasons, the minimum value of the periodically varying fluidization gas flow velocity in the HTC should preferably be maintained at a level corresponding to at least 10%, preferably at least 20%, of the maximum value of the periodically varying fluidization gas flow velocity in the HTC.

The flow velocity of the gas being introduced into the heat transfer chamber may also be periodically varied according to e.g. a step-wise function, a saw-tooth function, a sin-function or the like. The form of the function, as such, normally is not important. The form of the function generally depends on the construction of the means providing the periodically varying flow of fluidizing gas and/or means for varying a parameter of the periodical flow of fluidizing gas. In order to be able to vary the average flow of fluidizing gas and the effective heat transfer rate, it should be possible to vary at least one of the parameters of the function.

As mentioned earlier, the heat transfer coefficient in a bubbling fluidized bed typically changes from a low value to a much higher value rather abruptly within a narrow fluidizing gas flow velocity range. The heat transfer coefficient reaches a maximum at a certain flow velocity and decreases again at higher flow velocities. In the following, the fluid velocity range, where the heat transfer coefficient for instantaneous heat transfer changes from 60% of its maximum to 80% of its maximum, is called the "transition velocity range" and the fluid flow velocities lower than the "transition velocity range" are called "low" velocities and fluid flow velocities higher than the "transition velocity range" are called "high" velocities.

In a preferred embodiment said periodically varying fluidizing gas flow velocity depends on time as a time dependent step-function, i.e. a function, the value of which alternates between two constants, one of which represents a "low" velocity and the other a "high" velocity. Thus, the parameters of the periodical flow are the durations and velocities of the "high" and "low" parts of a flow period. During the sub-period when the velocity is "high", there is high instantaneous heat transfer rate in the heat transfer surfaces. When the velocity is "low" the instantaneous heat transfer is low. When the periodical function is such, that the bed is always or most of the time in the "high" state, the effective or average overall heat transfer rate is high. When the proportion of the "high" velocity is small, the effective heat transfer rate is low.

The periodically varying gas flow velocity function does not necessarily have to be a step-function alternating between two constants, but can, if desired, be another suitable time dependent function, however, preferably varying within a range limited by a "low" and a "high" velocity, the "low" and "high" velocities preferably being predetermined.

FIG. 1*a* schematically illustrates a periodical, step-wise alternating flow function. $t_1$ is the duration of the "high" flow velocity and $t_2$ that of the "low" flow velocity. At points denoted by i) and ii) in FIG. 1*a*, as also in other examples 1*b*, 1*c* and 1*d*, the effective heat transfer rate increase from a low value to an intermediate value and from an intermediate value to a high value.

At atmospheric pressure the transition flow velocity range, separating regions of high and low heat transfer, is typically near 0.2 m/s for fine bed material and between 0.4 and 0.5 m/s for coarse bed material. Thus at ambient pressure for fine bed material, such as bed material circulating in a CFB reactor, "high" flow velocities, or the upper limit for the flow velocity, may be e.g. $\geqq$0.2 m/s, typically $\geqq$0.25 m/s. The difference between the "high" and "low" flow velocity being >0.1 m/s, preferably >0.15 m/s. Similarly, at ambient pressure for coarse bed material, such as ash material discharged from the lower part of a CFB reactor, the "high" flow velocities may be e.g. $\geqq$0.4 m/s, typically $\geqq$0.5 m/s. The difference between "high" and "low" flow velocities being >0.2 m/s, preferably >0.25 m/s respectively. The difference between the "high" and "low" flow velocity should, however, not exceed the value of the "high" flow velocity, as a minimum "low" flow velocity is to be maintained at all times, in order to prevent problems, such as agglomeration, leakage of nozzles, blockage of nozzles and instability in the system, arising with zero or too low flow velocities.

It has, however, been noted that the "high" and "low" flow velocity values strongly depend on pressure. Thus at elevated pressures, e.g. at 10 bar, the above mentioned flow velocity values may have to be divided by two or more.

The periodically varying instantaneous heat transfer coefficient of heat transfer surfaces in a fluidized bed depends besides on pressure, on the size, roundness and density of the bed particles. Thus according to one aspect of the present invention the flow velocity range, which separates "high" and "low" flow velocity values, may be hard to define as a velocity range. Alternatively, the range may be defined as the range, where the instantaneous heat transfer coefficient changes from 60% to 80% of its maximum value. The maximum value of instantaneous heat transfer being the maximum value practically obtainable by the specific heat transfer surfaces in the specific heat transfer chamber.

In FIG. 1*a*, so as also in other examples 1*b*, 1*c* and 1*d*, the broken horizontal line represents approximately the flow velocity range, which separates the regions of high and low heat transfer coefficients.

In a preferred embodiment the duration of the "high" flow velocity sub-period is constant, e.g. 2.0 s, and the duration of the "low" flow velocity sub-period may for heat transfer control purposes be varied between certain values, say 0 s and 10 s, to cover the desired heat transfer range. If desired the duration of "low" flow velocity sub-periods may be constant and the duration of "high" flow velocity sub-periods may be varied, or duration of both sub-periods may be varied. Sufficient mixing of the bubbling bed requires "high" velocity sub-periods within certain not too long intervals, these intervals should typically not exceed 30 s. Also, to avoid detrimental periodical variations of the temperature of the heat transfer medium or of the reactor, the sub-periods should in most cases be shorter than the corresponding thermal time constants of the system.

To filter out possible periodic thermal disturbances, e.g. cyclically varying steam temperature, the HTC may have two or more zones with separately controlled fluidizing gas inlets or two or more sets of separately controlled fluidizing gas inlets within the same area. The "high" and "low" flow velocity sub-periods may be arranged to occur in the separately controlled fluidizing gas inlets at different times in different zones or different sets of inlets. When fluidizing gases to the different inlets have their "high" flow velocities at different times, the risk for cyclical temperature variations is minimized. If the HTC has N zones, the periodic flow velocities are preferably operated with 360 degrees / N phase differences.

The periodic flow function may be of many other forms than the function described above. Because the effective heat transfer rate is in practice a complicated function of many parameters, any one of the parameters or any combination of them can be used as control variables. FIG. 1*b* shows, as another example, a step function, where the ratio of the durations of the "high" and "low" sub-periods is used as a control parameter.

The periodical flow function does not have to be a step-function, but it can be, e.g., a sine-function or a sawtooth-function with a variable offset or a sawtooth-function with a variable amplitude. FIGS. 1*c* and 1*d* show, as further examples, a sin-function and a sawtooth-function, which could be used as periodic flow functions.

In test runs performed, the effective heat transfer coefficient of the heat transfer surfaces in a HTC varied typically between 100 $W/m^2K$ and 400 $W/m^2K$. In these runs, the periodical fluidizing gas flow velocity was of the type shown in FIG. 1*a*. The duration of the "high" flow sub-period was kept constant, typically 1 s, and that of the "low" sub-period was varied. With 10 s "low" sub-period duration, the heat transfer constant was 100 $W/m^2K$ and with 0 s it was 400 $W/m^2K$. The heat transfer coefficient varied with intermediate durations substantially linearly between these extreme values. A useful control range from 100% to 25% was thus obtained.

An additional feature of this invention is that based on a need, which is observed e.g. by monitoring the temperature of the medium which convects the heat from the HTC, the rate of heat transfer from a fluid bed is adjusted by varying a parameter of the periodically varying velocity of the fluidizing gas in a HTC. The duration of high velocity gas flow sub-periods and low velocity gas flow sub-periods may also be altered according to a preset program to provide the desired heat transfer in said heat transfer chamber, i.e. for said temperature to reach the preset value.

When trying to establish stable conditions in processes utilizing fluidized bed reactors, a man familiar with this technology normally aims to avoid all types of variations in the system, not to cause them, Surprisingly it has now been found out that the heat transfer in the fluidized bed reactor can be controlled by expressly periodically varying the flow velocity using an appropriate flow function in a heat transfer chamber therein.

An observation behind this invention is that, due to the heat capacities involved in the system, such as metal tubes, fluid medium etc., it is possible to use periodically varying control procedures. Moreover, by using a periodically varying control procedure—with a not too long period—an ideally controllable operation can be obtained.

This invention is cost-effective and can easily be applied to practice, because in many cases it can be made operational by only minor changes in the existing HTC gas velocity control equipment.

By the procedure disclosed herein the response time of the heat transfer system-is short, because the time constant of the gas flow is of the order of a few seconds and that of the heat transfer surfaces typically also at most only some tens of seconds. By using different values for the parameters of the periodical velocity of the fluidizing gas flow, a wide control range, e.g. from 100% to 25%, can be obtained.

BRIEF DESCRIPTION OF THE DRAWINGS

The above and other objects, features and advantages of the present invention will become apparent from the following description, reference being made to the accompanying drawings, in which.

DETAILED DESCRIPTION OF THE INVENTION

Figure 1A:
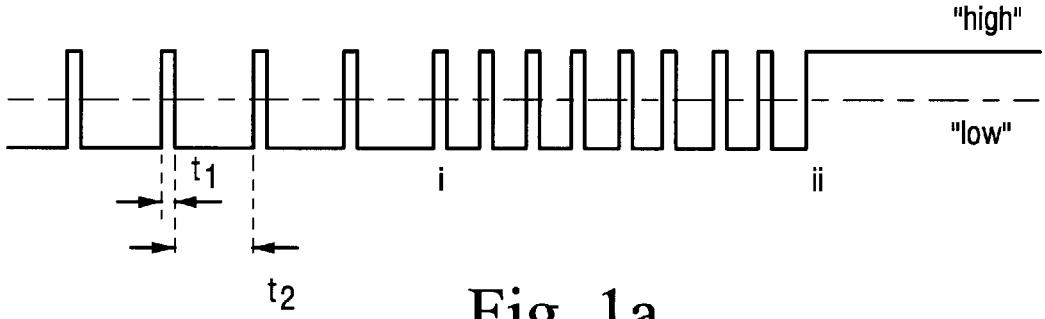
FIGS. 1*a* to 1*d* show graphs depicting periodical variations in flow velocity.
Figure 1B:
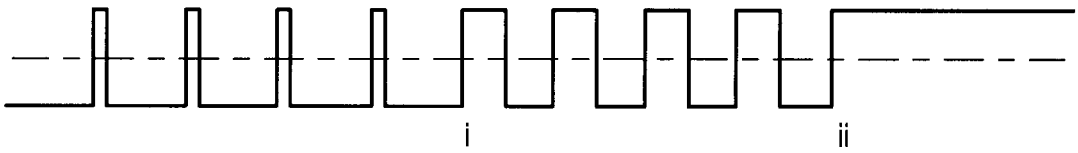
Figure 1C:
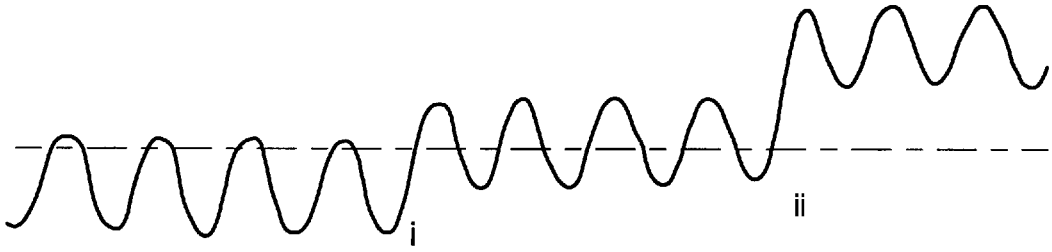
Figure 1D:
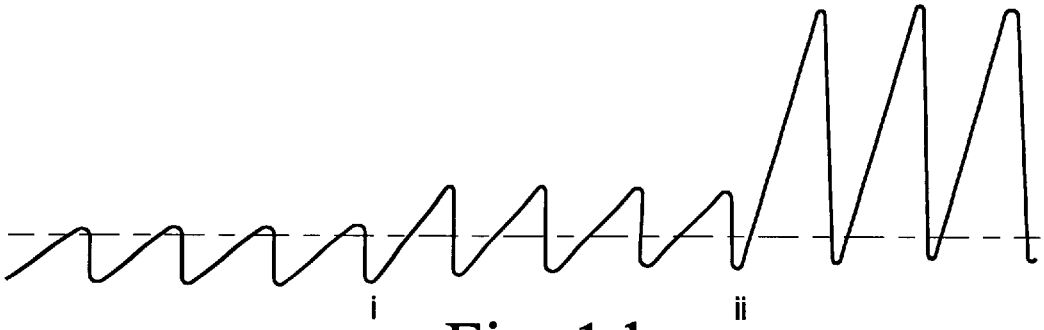
Figure 2:
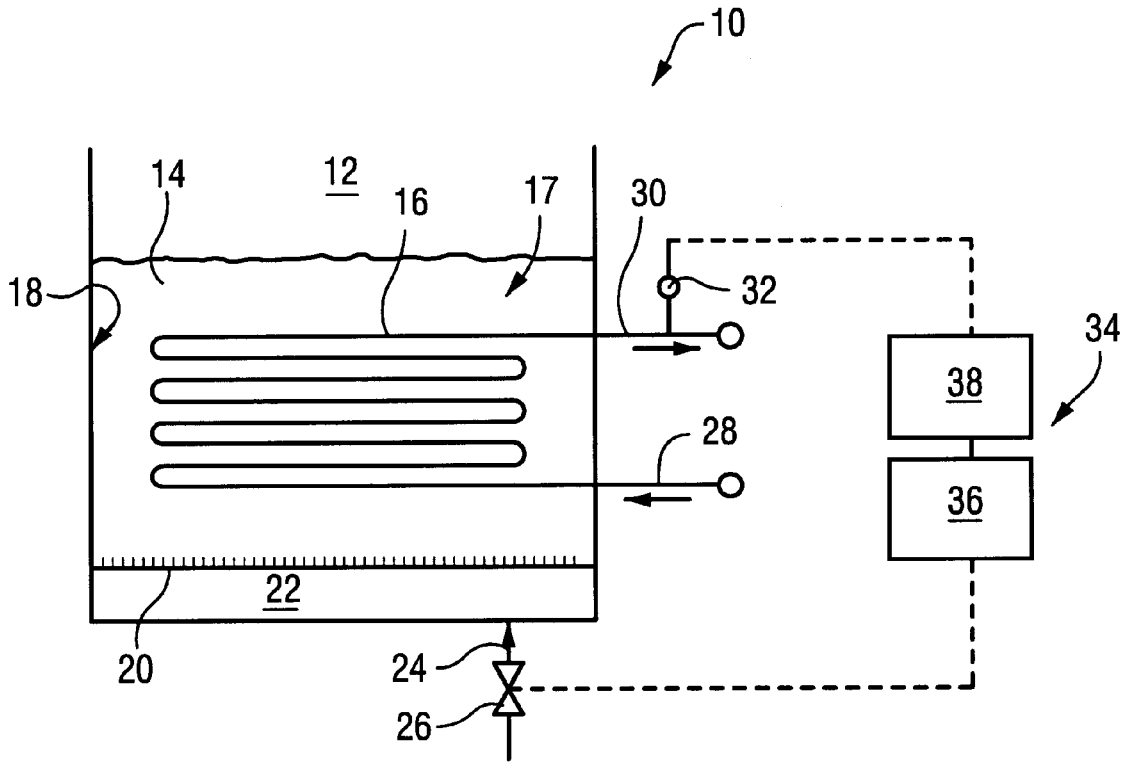
FIG. 2 is a schematic cross sectional view of the lower part of a bubbling fluidized bed reactor according to an exemplary embodiment of the present invention.
Figure 3:
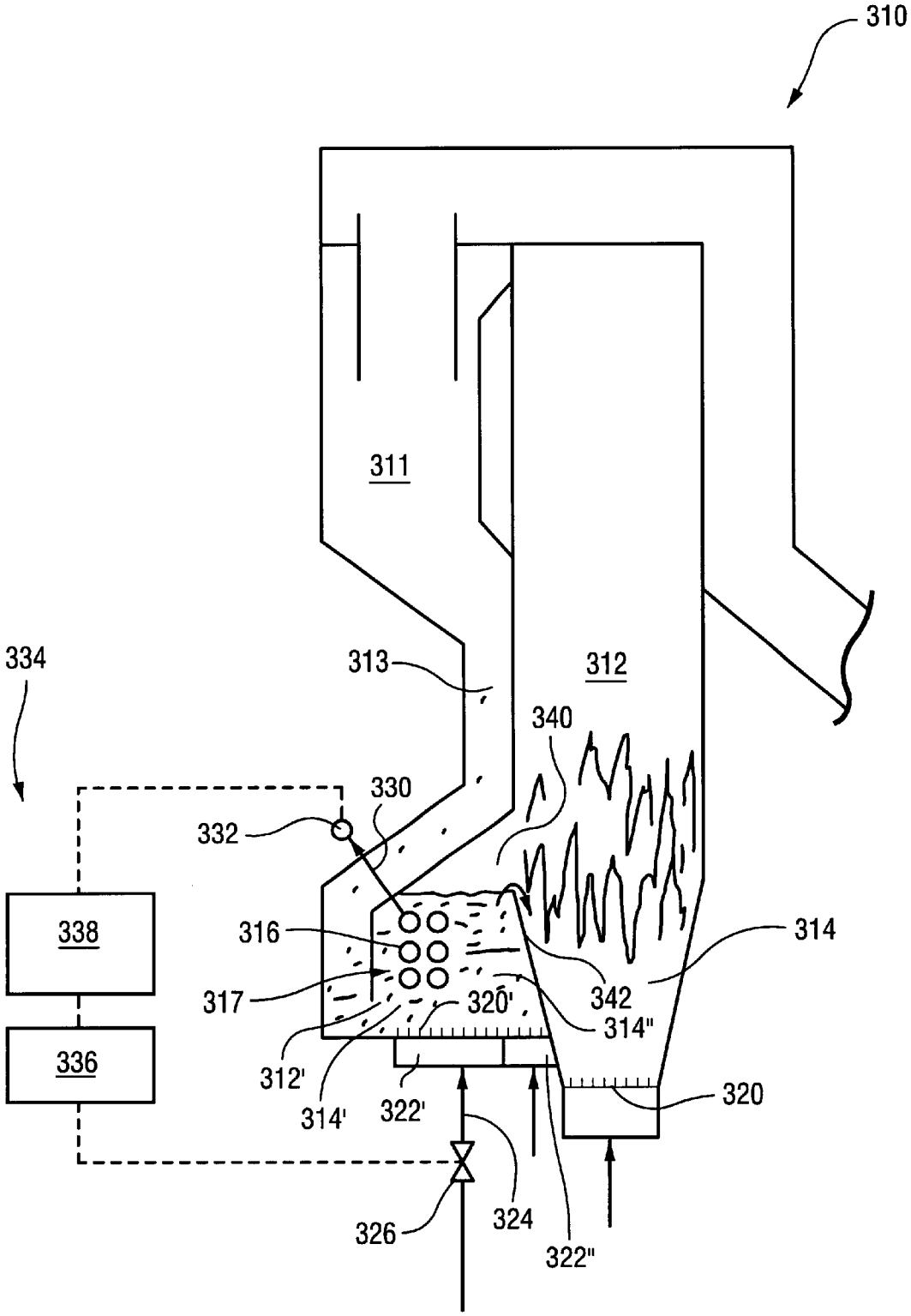
FIG. 3 is a schematic cross sectional view of a circulating fluidized bed reactor according to another exemplary embodiment of the present invention and FIGS. 4 and 5 are schematic cross sectional views of circulating fluidized bed reactors according to other exemplary embodiments of the present invention.
Figure 4:
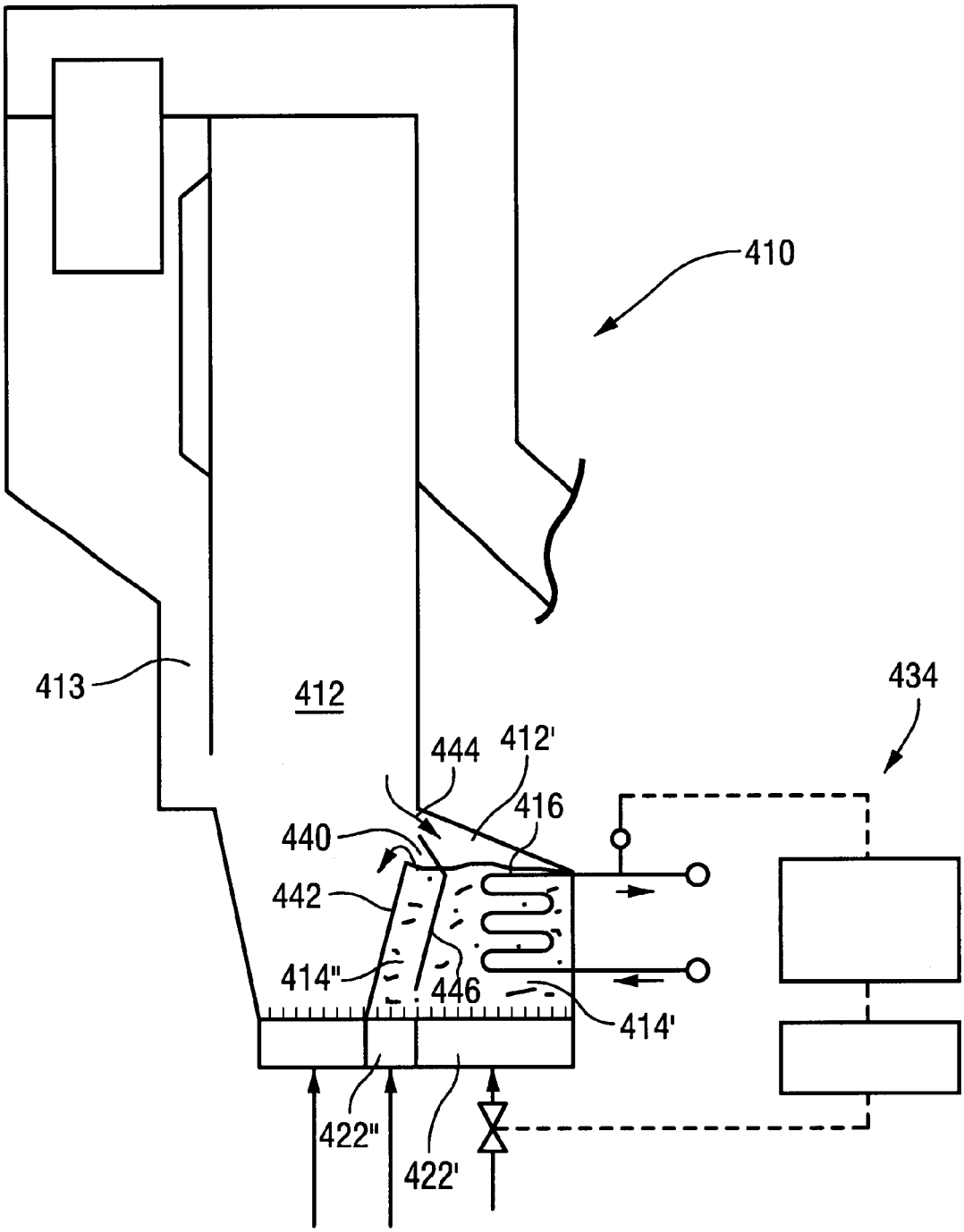
Figure 5:
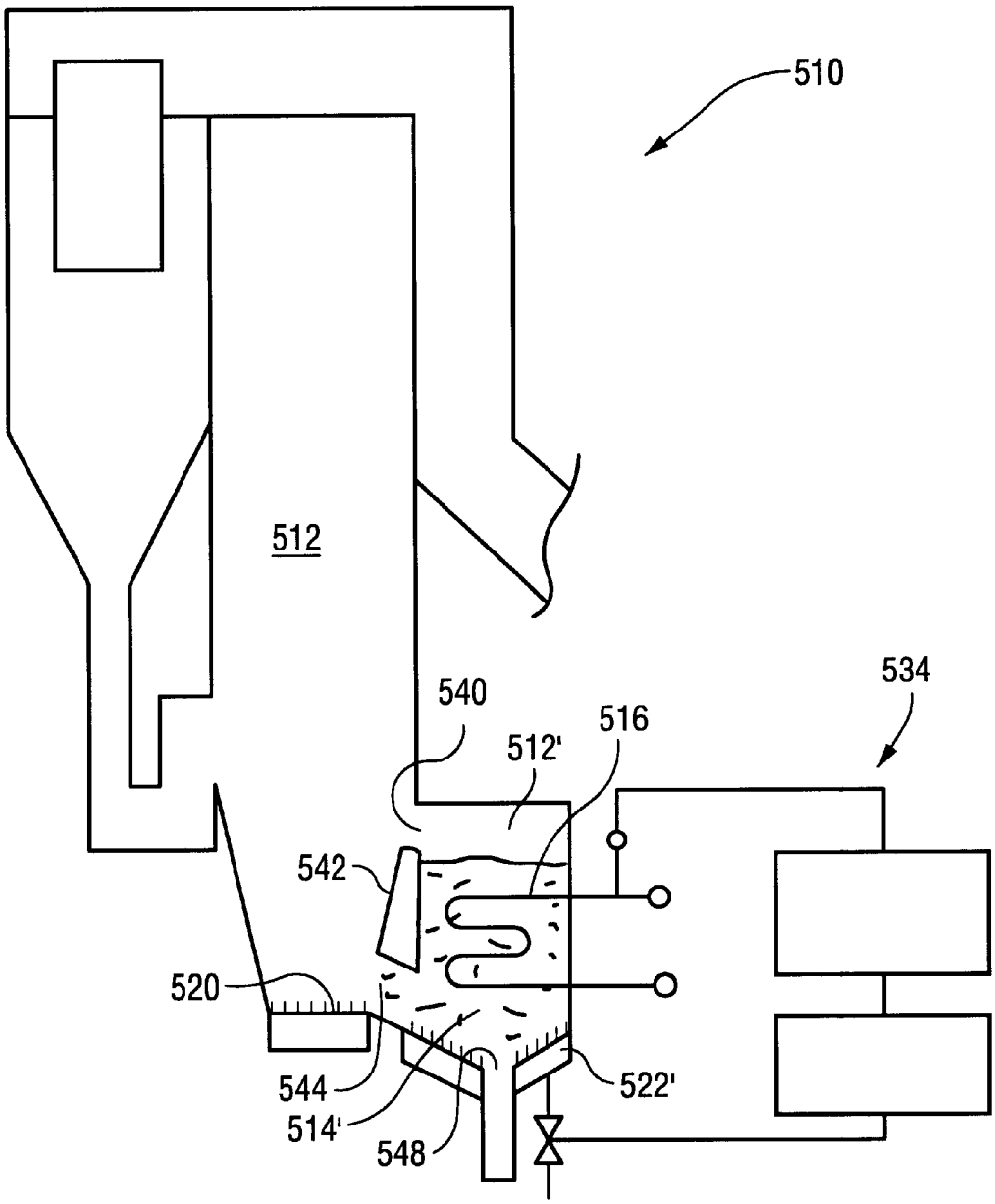

Referring now to the figures, the same reference numerals as in FIG. 2 will designate the same parts in FIGS. 3 to 5. Reference numerals in FIG. 3 being, however, preceded by a 3 and reference numerals in FIGS. 4 and 5 being preceded by a 4 or 5 correspondingly.

The method and apparatus of the present invention will first be described in connection with bubbling fluidized bed reactor 10, the lower part of the reactor chamber 12 thereof shown in FIG. 2 of the drawings.

FIG. 2 shows a very simple embodiment of the present invention, a fluidized bed reactor chamber 12 acting both as a processing chamber, such as combustion chamber, and a heat transfer chamber (HTC). A bubbling fluidized bed 14 is provided in the reactor chamber 12. Heat transfer surfaces 16 forming a heat exchanger system 17 are disposed within the fluidized bed 14 for recovering heat from the solid particles therein. Additionally or alternatively the walls 18 of the reactor chamber may be formed of heat transfer surfaces for providing a heat exchanger system.

A fluidizing air distribution grid 20 forms the bottom of the reactor chamber 12. Fluidizing gas, such as air, is introduced from a wind box. 22 through the grid 20 into the reactor chamber 12. A fluidizing gas inlet conduit 24 provides fluidizing gas into the wind box 22. A control means 26, such as a valve or similar, is provided for controlling the flow of fluidizing gas through the grid and thereby controlling the flow velocity of gas or air in the reactor chamber 12.

Heat transfer medium, such as water or steam, is introduced into the heat exchanger 17 for flow through the heat transfer surfaces 16, through heat transfer medium inlet conduit 28 and discharged at a higher temperature from the reactor chamber through heat transfer medium outlet conduit 30.

A temperature measuring or monitoring means 32, such as a thermometer, is disposed in the heat transfer medium outlet conduit 30, for monitoring the heat transported out of the heat exchanger and the need of change in heat transfer rate in the heat exchanger 17. The temperature monitoring means is disposed in the heat transfer medium flow downstream the heat transfer surfaces 16. The monitoring means 32 is connected to a control unit 34, controlling the introduction of fluidizing gas into the reactor chamber 12.

The control unit 34 includes a function generator 36, which controls the control means 26, such as one or several valves, in the inlet conduit or conduits 4, to render possible periodically varying fluidizing gas flow velocity in the reactor chamber 12; and an adjustment means 38, which is capable of adjusting parameters in the periodically varying gas flow velocity on the basis of signals from the temperature monitoring means 32 or otherwise given signals. The periodical gas flow velocity, generated by control unit 34 and control means 26, can be one of the types shown in FIGS. 1*a* to 1*d*.

The present invention may be applied to other bubbling fluidized bed reactors, as well, into which heat is transported by some other way than combustion.

FIG. 3 shows a schematic cross sectional view of a circulating fluidized bed, CFB, reactor 310, with reactor chamber 312, particle separator 311 and return duct 313. The reactor chamber 312 is a processing chamber, such as a combustion chamber, with a fast bed 314 of particles therein. The circulation of bed material in the CFB reactor 310 is controlled by controlling the introduction of fluidizing gas through the bottom 320 of the processing chamber. As circulating fluidized bed reactors are well known, their structure or operation is not described here in detail.

A heat transfer chamber, HTC, 312' is disposed in communication with the return duct 313, so that particles separated in the particle separator 311 flow through the heat transfer chamber 312' on their way back to the processing chamber 312. A bubbling fluidized bed is formed in the heat transfer chamber of the solid particles passing therethrough. The heat transfer chamber 312' and the bed of solid particles therein constitute a gas seal between the lower part of the reactor chamber 312 and the particle separator 311. Solid particles from the bed are reintroduced from the heat transfer chamber 312' into the processing chamber 312 by overflow through opening 340 in a common wall 342 between the chambers 312 and 312'.

Heat transfer surfaces 316 are disposed in the fluidized bed in the chamber 312', for recovering heat from the solid particles circulating in the CFB system. In the specific embodiment of the present invention shown in FIG. 3, the heat transfer surfaces 316 are disposed in a heat transfer zone 314' at a distance from the opening 340, so that a second zone 314" of the bed close to the common wall 342 does not contain heat transfer surfaces. The wind box below the grid 320' is divided into two separate portions 322', introducing fluidizing gas into the bed zone 314' including heat transfer surfaces, and 322", introducing fluidizing gas into the zone 314" without heat transfer surfaces. Thus it is possible to separately control fluidization of bed zones 314' and 314". Control of fluidizing gas introduced into the wind box 322" close to the common wall 342 controls discharge of solid particles by overflow through opening 340.

Control of fluidizing gas introduced into the wind box 322' controls the heat transfer from solid bed particles to heat transfer surfaces 316 according to the present invention. A valve 326 is disposed in a conduit 324 introducing gas into the wind box 322'. A control unit 334, with a function generator 336 and adjustment means 338, as well as, a temperature measurement device 332 connected to the outlet conduit 330 of the heat exchanger system 317 is provided, for controlling the heat transfer.

FIG. 4 is a schematic cross sectional view of another circulating fluidized bed reactor 410 according to another embodiment of the present invention. In this reactor 410 the heat transfer chamber 412' is disposed adjacent the processing or combustion chamber 412 of the reactor, but not in communication with the return duct 413 thereof.

An inlet opening 444 is provided in a common wall portion 442 bet n the processing chamber 412 and the heat transfer chamber 412' for introducing solid particles from the internal circulation of the processing chamber into the heat transfer chamber. Additionally an outlet opening 440 is provided in the common wall portion 442 for recirculating solid particles by overflow from the heat transfer chamber 412' into the processing chamber 412.

The heat transfer chamber is divided into a heat transfer zone 414', including heat transfer surfaces 416 and directly connected to the inlet opening 444, and a second zone 414" forming a transport zone and being connected to the outlet opening 440, for recycling solid particles into the processing chamber. Both zones are fluidized separately through wind boxes 422' and 422", respectively. A partition wall 446 is provided in the upper part of the heat transfer chamber between upper portions of zones 414' and 414", for preventing direct flow of particles between the upper portions.

The introduction of fluidizing gas through wind box 422' is controlled by a control unit 434 similar to control units shown in FIGS. 2 and 3, for controlling the heat recovery in heat transfer chamber 412'.

FIG. 5 is a schematic cross sectional view of another circulating fluidized bed reactor 510 according to still another embodiment of the present invention. In this reactor 510, having a combustion chamber 512, the heat transfer chamber 512' connected thereto is an ash cooler arranged to receive bed material discharged from the lower part of the combustion chamber 512. Heat transfer surfaces 516 are disposed in the heat transfer chamber 512', for recovering heat from the system.

Bed material is discharged from the combustion chamber 512 into the heat transfer chamber 512' through an opening 544 in a common wall portion 542 close to the bottom 520 of the combustion chamber. Another opening 40 is arranged above the opening 544 for allowing gas and fine solid material to flow from the heat transfer chamber 512' into the combustion chamber 512. An ash discharge opening 548 is arranged in the bottom of the heat transfer chamber 512', for discharging ash from the system. The heat transfer chamber 512' is not divided into two separate zones as solid material is not essentially recycled into the combustion chamber.

The introduction of fluidizing gas through a wind box 522' into the heat transfer chamber is controlled by a control unit 534 similar to control units shown in FIGS. 2 to 4, for controlling the heat recovery in heat transfer chamber 512'.

The form of the reactor or the heat transfer chamber may vary greatly from what has been shown in enclosed exemplary embodiments. It has been indicated that the fluidized bed reactor may be a combustor. The invention may, of course, be applied to other processes, as well, such as heat recovery in connection with hot gas cooling.

While, in the shown embodiments of the present invention control of heat transfer has been based on monitoring the temperature of heat transfer fluid immediately as it leaves the heat transfer chamber, the control may be based on other monitoring or measurements suitable. Also the need for changing heat transfer rate may be based on monitoring or measurements, at various locations within or outside the system. The control system may be designed to be controlled automatically or manually.

What is claimed is:

1. A method of controlling heat transfer in a fluidized bed reactor having a heat transfer chamber with heat transfer surfaces, and a bed of solid particles within the heat transfer chamber which move into contact with the heat transfer surfaces, said method comprising:

step (a) of continuously introducing fluidizing gas into the heat transfer chamber to fluidize the bed of solid particles and to cause heat to be transferred from the fluidized solid particles to the heat transfer surfaces by the particles moving into contact with the heat transfer surfaces;

step (b) of cyclically varying the flow velocity of the introduced fluidizing gas between two or more different positive flow velocities, and step (c) adjusting fluidization of the bed of solid particles by changing a cycle period of the cyclically varying flow velocity.

2. A method as recited in claim 1 wherein the solid particles comprise fine bed particles used in a circulating fluidized bed reactor; and wherein a highest flow velocity of the two or more different positive flow velocities is greater than 0.25 meters per second, and a difference between the highest flow velocity and a lowest flow velocity is greater than 0.15 meters per second.

3. A method as recited in claim 1 wherein cyclically varying the flow velocity is practiced by varying the flow velocity according to a sine function.

4. A method as recited in claim 1 wherein cyclically varying the flow velocity is practiced so that an instantaneous heat transfer co-efficient for heat transferred from the solid particles to the heat transfer surfaces at a lowest velocity of the two or more different positive flow velocities is less than 60% of the maximum instantaneous heat transfer co-efficient, and so that the instantaneous heat transfer co-efficient at a highest velocity of the two or more different positive flow velocities is more than 80% of the maximum value of the instantaneous heat transfer co-efficient.

5. A method as recited in claim 1 wherein cyclically varying the flow velocity between two or more different positive flow velocities is practiced to produce a high velocity gas flow and a low velocity gas flow, and to maintain the duration of the high velocity gas flow substantially constant during each cycle period and to vary a duration of a low flow velocity gas flow during each cycle period.

6. A method as recited in claim 5 wherein cyclically varying the flow velocity is practiced so that a duration of a low velocity gas flow of the two or more different positive flow velocities is less than 30 seconds during each cycle.

7. A method as recited in claim 1 wherein cyclically varying the flow velocity is practiced so that a duration of each of a highest flow velocity and a lowest flow velocity of the two or more different positive flow velocities does not exceed 30 seconds during repeated cycles.

8. A method as recited in claim 7 wherein cyclically varying the flow velocity is practiced so that a difference between a highest and lowest flow velocities of the two or more different positive flow velocities is greater than 0.15 meters per second.

9. A method as recited in claim 1 wherein cyclically varying the flow velocity is practiced to produce a high velocity gas flow and a low velocity gas flow, and to vary the duration of the high velocity gas flow portion of the cycle period, and to maintain a duration of the low flow velocity gas flow portion of the cycle period substantially constant.

10. A method as recited in claim 1 wherein periodic thermal disturbances are substantially prevented by practicing the continuous introduction of the flow of fluidizing gas into at least a first zone of the heat transfer chamber, and into a separate second zone of the heat transfer chamber.

11. A method as recited in claim 1 further utilizing a combustion chamber in solid particle flow communication with the heat transfer chamber; and further comprising step (d) of generating heat in the combustion chamber to heat solid particles which flow into the heat transfer chamber; and wherein heat is recovered from the combustion chamber with the heat transfer surfaces in the heat transfer chamber.

12. A method as recited in claim 8 wherein the fluidized bed reactor comprises a circulating fluidized bed reactor including a reactor chamber and a solid particle separator, and wherein the heat transfer chamber is connected to a return duct connecting the particle separator to a lower portion of the reactor chamber; and wherein heat generated in the reactor chamber is recovered utilizing the heat transfer surfaces in the heat transfer chamber.

13. A method as recited in claim 1 further comprising step (d) of automatically monitoring the heat transfer requirements of the fluidized bed reactor; and wherein the continuous introduction of fluidizing gas and the cyclically varying of the flow velocity of the introduced fluidizing gas are practiced so as to control the fluidizing gas introduction in response to the monitoring of the heat transfer requirements.

14. A method as recited in claim 1 further comprising step (d) of monitoring the temperature of heat transfer medium in the heat transfer surfaces; step (e) of comparing the monitored temperature to a pre-set value; and varying time durations for different velocity gas flows according to a pre-set program to provide a desired heat transfer in the heat transfer chamber so that the monitored temperature reaches the pre-set value.

15. A fluidized bed reactor comprising:

a heat transfer chamber including heat transfer surfaces, and a bed of solid particles disposed in said heat transfer chamber, some of said particles in contact with said heat transfer surfaces;

means for substantially continuously introducing fluidized gas into said heat transfer chamber for fluidizing said bed of solid particles therein;

means for cyclically varying the flow velocity of fluidizing gas introduced into said heat transfer chamber between two or more different positive flow velocities, and means for adjusting a fluidization of the bed of solid particles by changing a cycle period of the periodically-varying flow velocity.

16. A fluidized bed reactor as recited in claim 15 wherein said means for periodically varying the flow velocity comprises: means for automatically monitoring the heat transfer requirements in said heat transfer chamber; and means for processing the monitored heat transfer requirements and changing a parameter of said flow velocity varying means in response thereto.

17. Apparatus as recited in claim 16 wherein said monitoring means comprises temperature measuring means for measuring the temperature of heat transfer medium in said heat transfer surfaces.

18. A fluidized bed reactor as recited in claim 15 wherein said means for periodically varying the flow velocity comprises an automatically controlled valve.

19. A fluidized bed reactor as recited in claim 15 further comprising a combustion chamber in solid particle flow communication with said heat transfer chamber.

20. A fluidized bed reactor as recited in claim 15 wherein said fluidized bed reactor comprises a circulating fluidized bed reactor including a reactor chamber and a solid particle separator and a return duct connecting said particle separator to a lower part of said reactor chamber; and wherein said heat transfer chamber is connected to said return duct.

* * * * *